US006280499B1

(12) United States Patent
Koffron

(10) Patent No.: US 6,280,499 B1
(45) Date of Patent: Aug. 28, 2001

(54) YIELD METAL POURING SYSTEM

(76) Inventor: Robert J. Koffron, 28009 Hickory Dr., Farmington Hills, MI (US) 48331-2952

( * ) Notice: Subject to any disclaimer, the term of this patent is extended or adjusted under 35 U.S.C. 154(b) by 1157 days.

(21) Appl. No.: 08/665,992

(22) Filed: Jun. 19, 1996

Related U.S. Application Data

(63) Continuation of application No. 08/365,362, filed on Dec. 28, 1994, now abandoned.

(51) Int. Cl.[7] ..... C21C 1/04

(52) U.S. Cl. ..... 75/375; 266/45; 266/90; 266/236

(58) Field of Search ..... 266/236, 44, 90, 266/275, 45; 75/375

(56) References Cited

U.S. PATENT DOCUMENTS

| | | | |
|---|---|---|---|
| 3,695,604 | 10/1972 | Stein | 266/43 |
| 4,413,810 | 11/1983 | Tenberg | 266/94 |
| 4,431,169 | 2/1984 | Fuzii | 266/236 |
| 4,478,392 | 10/1984 | Fuzii | 266/44 |
| 4,526,349 | 7/1985 | Schwer | 266/45 |
| 4,544,140 | 10/1985 | Tenberg | 266/99 |
| 4,601,415 | 7/1986 | Koffron | 266/97 |
| 4,709,903 | 12/1987 | LaBate | 266/227 |
| 4,718,644 | 1/1988 | Hoffman | 266/99 |
| 4,799,650 | 1/1989 | Labate | 266/227 |
| 4,871,148 | 10/1989 | Koffron | 266/230 |
| 4,880,212 | 11/1989 | Hagglund | 266/94 |
| 4,986,517 * | 1/1991 | Ford et al. | 266/236 |
| 5,044,610 | 9/1991 | Koffron | 266/45 |
| 5,190,717 | 3/1993 | Bayliss | 266/80 |
| 5,203,909 | 4/1993 | Petrushka | 75/375 |

* cited by examiner

*Primary Examiner*—Scott Kastler
(74) *Attorney, Agent, or Firm*—Brooks & Kushman P.C.

(57) ABSTRACT

Clean metal pour form a tilting, side-tapped furnace containing metal and slag is maximized by determining metal residuum remaining in the furnace from measuring the liquid metal poured into the receiving ladle and adjusting the furnace tilt angle to minimize vortex formation and minimize slag entrainment. Measurement of the necessary parameters avoids the use of operator judgment. In a preferred embodiment, adjustment of the tilt angle is computerized based on data received from appropriate sensing devices, avoiding both operator judgment as well as operator control.

18 Claims, 1 Drawing Sheet

YIELD METAL POURING SYSTEM

This is a continuation of application Ser. No. 08/365,362 filed on Dec. 28, 1994, now abandoned.

TECHNICAL FIELD

The present invention pertains to a process for pouring metal. More particularly, the present invention pertains to a process for pouring metal having a layer of slag disposed thereon, whereupon a high yield of slag-free metal may be obtained.

BACKGROUND ART

In the smelting and refining of metals, the occurrence of a lower density layer of slag atop the metal surface is common. In many cases, this floating slag layer is purposely provided as a sink for impurities which might otherwise remain in the refined metal, and to prevent oxidation of molten metal in the presence of atmospheric gases. However, as important as the layer of slag may be for achieving its intended purposes, entrainment of slag in metal poured from the furnace or ladle results in a product which must be downgraded, reworked or scrapped.

In the basic oxygen process, for example, the furnace charge consists of scrap steel of varying amount, generally from 15–30% by weight, but up to 45% by weight with preheating, onto which a layer of molten pig iron is poured. Ferrosilicon and other ingredients are added and oxygen injected through a lance. The combination of oxygen with iron, silicon, and other ingredients forms a slag which rises to and covers the surface. The slag comprises nominally about 13 weight percent of the furnace contents, or about 28% by volume. The slag not only serves to retain impurities and further prevent unwanted oxidation, but also serves to keep oxygen and other gases in solution, to avoid effervescence from the melt.

The geometry of basic oxygen and other furnaces varies somewhat, but generally consist of a cylinder with a concave or flat bottom, together termed the "barrel", surmounted by a "cone" whose diameter tapers toward the upper end of the furnace mouth.

In pouring steel from the furnace, past attempts to avoid slag entrainment have included tilting the furnace on its pivot or trunion and decanting the lighter slag from the steel. This method has not proven successful, however, as the hot slag and molten metal were found to adversely affect the refractory lining along the mouth of the furnace. Moreover, it is difficult to remove the slag completely without some molten steel pouring over and coating the rim. Thus, steel is now almost universally withdrawn by gravity flow through a taphole, located generally at the intersection of the cone and barrel of the furnace.

Pouring the steel through the taphole thus described has the advantages of avoiding damage to the rim of the furnace mouth and the risk of forming a layer of steel thereupon. It has the further advantage that the protective slag layer remains floating on the surface of the liquid steel, shielding it from the atmosphere as well as avoiding effervescence. However, as the level of steel in the furnace diminishes, a vortex is created which draws slag into the metal being poured. To avoid this, numerous preventative methods have been devised.

In U.S. Pat. No. 4,431,169, an elongated stopper mounted on a boom is inserted proximate the taphole, and lowered to block the pour when the amount of metal remaining is low.

The boom is then raised a small amount, allowing a slow pour of metal from the furnace without creating a vortex. This method utilizes relatively expensive control apparatus and is subject to a great deal of error, because the mouth of the taphole cannot be seen. The error is compounded when the mouth of the taphole has been eroded from use. Moreover, a slight error in the timing of the retraction of the plug from the taphole can allow slag to be entrained in the steel being poured, or worse, could cause blockage of the taphole by steel which has cooled too much due to the slower pour speed with the taphole mouth partially blocked.

In U.S. Pat. No. 4,799,650, a "dart" closure having a higher specific gravity than slag but lower than steel has an elongated hexahedral extension which acts as a vortex inhibitor. When the level of steel decreases to an amount determined by the geometry and density of the device, the elongated extension of the device enters and obstructs the taphole, preventing further pour of steel and slag. Such devices are of lesser usefulness in conventional side-tapped furnaces where the depth of metal above the taphole is limited, thus permitting the device to descend sideways such that the extension passes by the taphole and thus cannot obstruct the taphole at the appropriate time. Moreover, not only is a substantial amount of steel retained in the furnace when the dart enters the taphole, but also the dart is difficult to remove from the taphole. A device having a tetrahedral shape but without the elongated extension is a distinct improvement, as taught by U.S. Pat. No. 5,044,610. This device restricts vortex formation, and allows an increased pour of metal before the device obstructs the taphole. However, even with the '610 device, some slag may yet be entrained in the steel, especially if the operator-controlled furnace tilt angle is far from optimum.

In U.S. Pat. No. 5,203,909, as the amount of steel diminishes, a lance providing a pressurized jet of air or inert gas is positioned above the surface of the metal/slag interface, thereby literally blowing the slag away from the taphole. Correct positioning of the lance is necessary, however, and the use of large quantities of inert gas such as argon increases cost.

In U.S. Pat. No. 4,718,644, a slag sensor is disclosed for mounting on a non-ferromagnetic taphole nozzle. The sensor comprises electromagnetic coils located on opposing sides of the nozzle, and detect the presence of slag by measuring eddy currents and magnetic fields in the material flowing through the nozzle. Unfortunately, such devices do not alert the operator at the time when slag first is entrained in the molten metal, as during this transitional period when both slag and metal exit the nozzle, the relatively large amount of metal is enough to support large eddy currents and magnetic fields. By the time the proportion of slag increases to such an extent that slag is detected, a significant amount of slag has already passed through the taphole and into the ladle. Moreover, the electric motors and reduction gearing which provide the driving force for tilting the large and heavy furnace is only responsive on the order of several degrees of tilt per second. Even if the slag sensor could alert the operator to the onset of slag entrainment, the inertia of the furnace would yet allow for slag entrainment before the furnace is tilted back to a position where the taphole is above the slag.

Despite the many attempts to maximize metal yield while minimizing slag entrainment, the predominant technology in use today is a combination of vortex-reducing floats having a specific gravity between that of slag and that of steel, and operator control of the tilt of the furnace to regulate flow of steel through the side-mounted taphole. As both the slag and steel are intensely hot, emitting enormous amounts of both visible and infrared radiation, the operator cannot easily determine visually the level of steel hidden below the slag layer.

Furnace linings, in general, are quite thick, for example in excess of two feet thick with an additional "safety" lining of from 6–9 inches. Such linings are replaced after from 5000 to 6000 heats. During the initial campaigns, the thickness of such linings and attendant volume of the furnace prevent the furnace from being tilted past 97–98° during the last portion of a pour. As the furnace matures, the lining is eroded and the pour angle increases until it reaches a value of from 110–111°.

Determination of the slag content of the furnace is thus not only difficult, but moreover, this determination is rendered more difficult by the natural wear and erosion of the furnace refractory interior. In addition, the error is compounded by the normal variance in observation and reaction, particularly with respect to differences in operator experience and skill level, attentiveness, and the like. Thus, the industry still awaits a satisfactory solution to slag entrainment and yield maximization.

SUMMARY OF THE INVENTION

The present invention provides for maximum metal yield and minimum slag pour and/or entrainment through sensing the amount of metal poured from the furnace, sensing the amount of slag remaining in the furnace, sensing the tilt angle of the furnace and determining from these objective measurements, the correct tilt angle of a side-tapped furnace.

The present invention improves the yield of metal from a tilting, side-tapped furnace while minimizing slag entrainment. The present invention also improves metal yield and minimizes slag entrainment by providing objective indicia of pour parameters, thus minimizing operator error, and in one embodiment of the present invention, automated control of metal pour is provided.

The above objects and other objects, features, and advantages of the present invention are readily apparent from the following detailed description of the invention when taken in connection with the accompanying drawings.

DESCRIPTION OF THE PREFERRED EMBODIMENTS

Figure 1:
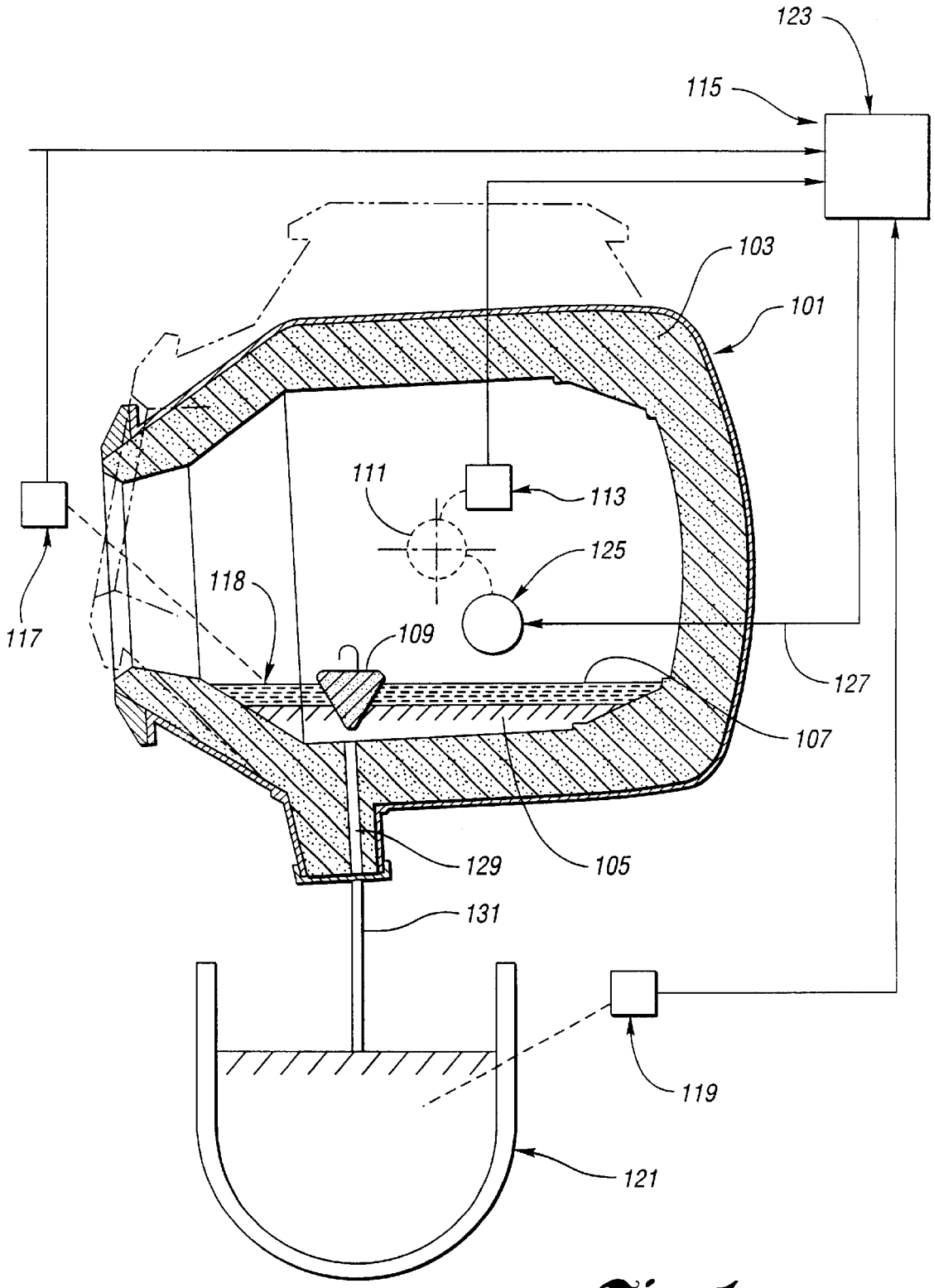
FIG. 1 illustrates a side-tapped furnace containing slag and molten metal discharging metal into a metal-receiving ladle.

The process and apparatus of the subject invention are for use in side-tapped furnaces of conventional design. Use in bottom-tapped furnaces is not contemplated. By the term "side-tapped furnace" is meant a furnace having a tap-hole located on the side of the furnace through which molten metal exits as the furnace is tilted. Such furnaces are generally constructed of steel and refractory lined, although for some metals other than steel, a non-lined furnace may be satisfactory. Such side-tapped furnaces generally contain approximately 250 tons of steel, and are pivoted on trunions or other means. Tilting of the furnace is controlled by electric motors or hydraulic means.

By the term "slag" is meant "slag or dross", i.e. a mixture of molten metal oxides and other materials, often containing significant amounts of alkali and alkaline earth metals and silicon, which occurs of necessity or design above a layer of molten metal in a furnace. The term "slag" used herein is the normal commercial meaning, and is not intended to have a different meaning other than that naturally ascribed to it by those in the metallurgical arts.

In order to perform the process of the subject invention, it is necessary to ascertain the values of certain parameters associated with the metal smelting or refining process.

The period of time which is critical during the end of the furnace pour is the period wherein about 15% or less of metal residuum is present. At least during this time or a portion thereof, the amount of steel poured from the furnace is used to back-calculate the metal residuum. This value, together with the optimal tilt angle, is used to control the pour during this stage of the process. In conventional methods of pouring steel, the period toward the end of the pour is very problematic, the operator frequently allowing the pour to continue, believing only steel to be entering the taphole, while in reality, a mixture of slag and steel is being poured. The subject invention substantially avoids this situation.

The critical tilt range is the range on either side of the angle for any given furnace design wherein the taphole is lowest with respect to gravity, the "verticulum angle", and which must be subject to fine adjustment as the metal residuum, i.e. the amount of metal remaining in the furnace toward the end of the pour, reaches a low value and the danger of vortex formation and slag entrainment increases. The critical tilt range is approximately 5 degrees on either side of the verticulum angle, but may vary beyond this point in a newly lined furnace. The optimal tilt angle is the angle within the critical tilt range which is capable of supplying liquid metal through the taphole with minimal vortex formation and minimal slag entrainment for any given amount of metal residuum. The optimal tilt angle is best ascertained historically.

Each furnace is generally campaigned for approximately fifty heats before the taphole refractory is replaced, and many thousands of heats before relining the entire furnace. A given furnace design will literally produce tens or hundreds of thousands of heats prior to replacement. Recommended tilt angles are in general known even prior to the first campaign, as the furnace geometry, as described below, may be used to estimate the correct tilt angle. Refinement of the recommended tilt angle to the optimal tilt angle may be accomplished by monitoring the vortex and slag entrainment during the early runs of the first campaign.

The interior geometry is fixed during the design of the furnace and is therefore known with accuracy. Moreover, simple measurements made following the lining or relining of the furnace with refractory material may be used to fine tune the designed internal geometry. From the internal geometry and tap location, the volume of the metal pool above the taphole may be calculated for varying degrees of tilt within the critical tilt range, i.e., a range of tilt of plus or minus about 2–5° from the position determined to be the optimal angle of pour as the pool of metal in the furnace diminishes.

The internal geometry may also be used to calculate the height of the slag above the taphole at various weight percent slag concentrations and at varying metal content. In normal operation, the slag does not decrease in volume as the metal flows out beneath it, but the height of the slag layer above the taphole will change in a predictable but irregular fashion which can be calculated from the slag volume (determined by the slag weight percent and total charge) together with the internal geometry presented to the slag at each degree of tilt and with a given metal residuum below the slag.

The calculations of slag height and metal height can be accomplished by one skilled in geometry, and do not present any particular problem. Preferably, using modern CAD/CAM computer programs, the various volumes and heights are calculated automatically. Moreover, once the calculated values are known, the variables of furnace tilt, metal residuum volume, slag volume, etc. may be input to standard computer programs to derive an equation of closest fit. Alternatively, the various parameters may be plotted versus tilt angle, one set of plots for each furnace charge.

In order to determine the optimal tilt angle, a tilt indicating means must be installed on the furnace. Means to indicate tilt are, in general, well known, and include rotary variable capacitance sensors, inductive sensors, DC servo motor sensors, and the like. Preferably, the sensor should be capable of measuring the degree of tilt of the furnace within ±1°, more preferably ±0.5°, and most preferably within 15 minutes over the critical tilt range. During the first series of furnace runs, the vortex formation and slag entrainment is noted along with the furnace tilt angle as provided by the tilt indicating means. The tilt angle may be presented in an analog manner, but preferably is presented in the form of a digital output or readout.

The furnace metal output is measured. As the charge of the furnace is generally known within ±2%, the metal output is a useful measure which may be used to calculate the metal residuum. The metal output may be measured in a variety of ways. For example, the ladle into which the metal pours may be provided with a scale or load cell and tared prior to the pour. As the metal pour continues, the weight of the ladle less its tare weight provides the amount of steel poured. Alternatively, the steel in the ladle may be viewed with a video camera and the image compared to stored images using procedures similar to those used in conventional image recognition robotic techniques. By subtracting this amount from the charged amount, the metal residuum weight and volume may be calculated.

Alternatively, the height of steel in the ladle, in conjunction with the ladle geometry, may be used to provide the amount of steel poured. Although the height of liquid steel may be gauged by the operator, it is desirable that the height be measured by means which avoid operator judgment and participation, such as the video means described above. Other such means are available, and include microwave sensors where the reflection of microwaves from the hot steel surface is monitored and converted to a distance measurement; conductive probes which may be lowered onto the liquid steel surface, the onset of conductivity used to trigger an electrical circuit which calculates height based on the position of the sensor from a reference point. Similar calculations based on height of a sensor from a reference point may be used for a variety of non-contacting sensors, for example hall-effect sensors, capacitance sensors, and inductive sensors. A conductive electrode sensor is disclosed in U.S. Pat. No. 4,413,810. Although designed for use in measuring the position of the slag/steel interface in the furnace, this type of device is even more suitable for measuring steel height in a ladle. A further device is disclosed in U.S. Pat. No. 4,544,140. A suitable microwave sensor which may be used to monitor steel height in a ladle or slag height in the furnace is disclosed by Tezuka et al., "M-Sequence Modulated Microwave Level Meter and Its Application", 1994 Steelmaking Conference Proceedings, pp. 181–185.

In the preferred control process according to the subject invention, the amounts of the various charges of slag forming ingredients, scrap steel, and pig iron are inputted to a computer and used to either calculate or determine, from a look-up table, the volume of steel and slag to be produced. Alternatively, these amounts may be provided to the computer by an operator from independent calculation or table. However, it is appropriate to link the computer program to the charging process by monitoring the weights of the various charges and applying the digitized output of the weight sensors directly to the computer input, thus again minimizing operator involvement.

The beginning of each pour may be operator controlled or may be controlled by computer. Since the amount of steel is large at this point, deviation from the recommended tilt angle is not particularly critical, as long as the tilt is enough to position metal over the tap and not so much as to spill slag over the rim. As the pour proceeds, the amount of steel in the ladle is determined and the amount input to the computer. When the amount of steel poured is within 80–90 percent of the charge, the computer takes over control of the electrically or electrohydraulically driven tilt means. For each incremental percent of total charge, for example each additional 0.2 to 1.0 weight percent, the computer determines either by calculation from a suitable equation or from a look-up table, the optimal tilt angle for the metal residuum remaining, and signals the electric motor or electrohydraulic system to cause the furnace to attain the determined tilt.

The preferred computer controlled tilting furnace is advantageously provided with manual override capability to allow operator control should an unusual event, for example computer malfunction, sensor failure, or the like occur. The advantage of the most preferred embodiment is that operator control and judgment are both substantially eliminated, thus producing consistent, repeatable pours which maximize clean metal yield.

Preferably, the process further includes use of the vortex inhibitors as disclosed in U.S. Pat. No. 5,044,610. As the metal residuum in the furnace decreases, the vortex inhibitor self-aligns with the taphole, decreasing vortex formation while also partially throttling the flow of steel during the last seconds of pour, allowing time for the furnace tilt to be adjusted to cut off the flow at the proper point. As the flow diminishes in response to the change in tilt angle, nozzle located slag sensors may now become useful, especially in conjunction with a nozzle gate or valve.

In a further preferred process, operator judgment is substantially eliminated but operator control maintained. In one embodiment of this further preferred process, the amount of metal poured, and thus the metal residuum remaining is determined. This determination may be relayed to the operator in the form of an alphanumeric display device, a computer screen, a labeled LED device, analog gauge, or other means. In a preferred embodiment of this further process, the metal residuum is translated to an optimal tilt angle either by the operator personally, i.e. by a look-up table or tilt angle versus residuum graph, or by inputting the poured metal parameter to a computer and calculating the tilt angle. The operator then adjusts the tilt of the furnace by manual control until the furnace tilt angle sensor indicates that the correct tilt angle has been achieved. Although the operator must control the process, the judgment of the operator is not involved.

The refractory furnace lining will be gradually eroded over time, thus changing the interior volume, of the furnace. In the most preferred process according to the subject invention, the increase in internal volume and any change in interior geometry will be factored into the computer program used to calculate the tilt angle. For example, historical knowledge of the changes to be expected may be factored into the program. Moreover, during the furnace down time while the refractory in the taphole is replaced, inspection and/or measurement of the erosion in the refractory lining may be made.

The height of slag for a given furnace charge is also reflective of the change in furnace internal volume, as for a given charge, the height of the slag layer will decrease as the volume of the furnace increases. The height of the slag layer will vary more as the metal residuum decreases, as the change in volume at this point of the process is greater relative to the initial volume of a newly lined furnace.

If a computer is not to be used to calculate the optimal tilt angle, but operator look-up tables or graphs are to be used instead, a separate set of look-up tables or graphs may be provided for successive increments of heats, for example a separate set of tables and/or graphs for each fiftieth heat or some other appropriate incremental value.

Measurement of slag height may be accomplished by known means, for example, by microwave techniques or the capacitively coupled antenna of U.S. Pat. No. 4,880,212. Incorporation of the change in interior volume to the means of determining tilt angle, particularly by actual measurement of slag height, permits an unprecedented level of control of clean metal output.

In FIG. 1, a side-tapped furnace 101 has a furnace lining 103 and contains molten metal 105 and slag 107. Shown at 109 is a vortex inhibitor as disclosed in U.S. Pat. No. 5,044,610. The axis of the supporting trunnions is shown at 111. Associated with this axis is tilt angle sensing means 113 whose output is inputted into computer control device 115. Input also to computer control device 115 are the output of slag height sensor 117 which detects the height 118 of slag 107, and metal output sensor 119 which measures the amount of metal delivered into ladle 121. A further input shown at 123 can be used to supply charge information or other data to the computer. At 125 is a tilt driving means responsive to a tilt angle adjusting output flowing through output line 127. The furnace spout is shown at 129, delivering metal stream 131 to ladle 121. The dashed lines in the Figures indicate interrelationships between the various sensors, tilt adjusting means, etc.

A typical run of computer-controlled metal pour is as follows. The weight of scrap steel, pig iron, ferrosilicon, alloying ingredients, and slag forming ingredients are input into the computer, either from weighing sensors or by hand. The computer calculates the expected metal yield, slag yield, and slag height. The operator then initiates the pour by tilting the furnace to a predetermined tilt angle, indicated on a computer monitor. As the furnace tilt passes a preset value associated with the onset of a pour, for example 78° from vertical, the computer clean-metal pour system is activated. The computer continually monitors the output of the sensors which measure the degree of tilt, the amount of metal poured into the ladle, and optionally, the slag height, and uses an algorithm tailored to the historically determined optimal tilt angles or calculated from the furnace geometry, to calculate the amount of metal residuum and to determine the optimal tilt angle as a function of the metal residuum. The computer then compares the calculated tilt angle with the actual tilt angle and signals the tilt drive mechanism to correct the actual tilt to the calculated tilt by activating a reversible gear driven motor, servomotor, or the valves of a pneumatic or hydraulic system which tilts the furnace in the necessary direction. As the metal pour is completed, the algorithm signals the tilt adjusting means to restore the furnace to vertical, or to remove the metal pouring spout located beneath the taphole and replace it with a spout to direct slag from the furnace. Except for the operator initiating the pour, no operator judgment or participation is involved.

In a typical non-computer controlled run, the amount of metal yield and slag yield are calculated by an operator or determined from a look-up table based on raw ingredient charge. The operator then activates the furnace tilting means to begin the pour. Digital or analog readouts indicate the current furnace tilt angle, percent of metal poured, and optionally the slag height. At each ten percent of metal poured until a metal pour of approximately 80 percent is realized, the operator consults a simple table supplying tilt angles and adjusts the tilt by manually activating the tilting means until the tilt angle readout is the same as that recommended for the particular range of metal pour. After about 80% of the pour is complete, the operator consults a table for each additional 2% of the pour, and adjusts the furnace tilt manually to the optimal angle provided by a table or graph, which may also factor in slag height and/or the change in volume expected for the number of runs the furnace has experienced since relining. Although operator participation is required, operator judgment is eliminated, as the correct tilt angle is determined from the table or graph, and the tilt angle readout indicates when the actual tilt angle equals the tilt angle recommended.

The process of the subject invention is particularly useful when used in conjunction with a vortex inhibiting device such as those disclosed in U.S. Pat. Nos. 4,601,415, 4,871,148, and 5,044,610, which are herein incorporated by reference. When such devices are utilized, they are ordinarily introduced into the furnace at the command of the operator, who visually determines the amount of steel remaining in the furnace. If the vortex inhibitor is introduced too early, the flow may be slowed enough to result in over-cooling of the molten steel, resulting in an off-spec product. If introduced too late, vortexing may already have allowed slag to be entrained in the poured steel.

As both steel and slag volume changes with differing amounts of charge, and as furnace lining erosion may considerably change the volume and geometry of the furnace, significant operator skill and experience is required to achieve any degree of uniformity in terms of the correct time to introduce a vortex inhibitor. When coupled with the potential for inattentiveness, the net result is considerable variation in steel output and quality.

In the present invention, the steel output, from which is calculated the metal residuum, optionally in conjunction with the measurement of slag height as indicative of lining erosion, may be used to give an aural or visual signal to the operator when time for introduction of a vortex inhibitor has been reached. This combination process involves a particularly high degree of synergism, since the throttling effect of the vortex inhibitor, in addition to reducing vortex-initiated slag entrainment, also serves to increase the pour time during the last few minutes of the pour such that fine control of furnace tilt may be achieved despite the large furnace inertia.

Having now fully described the invention, it will be apparent to one of ordinary skill in the art that many changes and modifications can be made thereto without departing from the spirit or scope of the invention as set forth herein.

What is claimed is:

1. A method of maximizing clean metal pour from a side-tapped tilting furnace during the last about 20% of metal pour, substantially avoiding operator judgment, comprising:

a) providing means for measuring the angle of tilt of said furnace while discharging liquid metal from said side tap into a ladle;

b) measuring the amount of metal contained in said furnace before said discharge into said ladle;

c) measuring the volume of metal discharged into said ladle;

d) determining the amount of metal residuum remaining in said furnace from said volume of metal discharged into said ladle;

e) adjusting said angle of tilt of said furnace to an optimal angle which provides for minimal slag entrainment in liquid metal pouring through said side tap, said optimal angle calculated as a function of the furnace geometry and historical data of furnace lining wear, for said amount of metal residuum.

2. The method of claim 1, wherein said determining the amount of metal residuum is calculated by a computer from said volume of metal contained in said furnace before said discharging and from said volume of metal discharged into said ladle.

3. The method of claim 1, wherein said determining of said volume of metal discharged to said ladle comprises the use of a sensing means which provides an output which is mathematically related to said volume of metal discharged.

4. The method of claim 1, wherein said adjusting of said angle of tilt of said furnace is controlled by the output of a computer.

5. The method of claim 1 further comprising measuring the height of slag within said furnace, and adjusting the angle of tilt of said furnace in response thereto to an optimal angle.

6. The method of claim 1 further comprising alerting an operator to said tilt angle measurement and at least one of said determinations (c) and (d), said operator adjusting said angle of tilt of said furnace in response to said determination (s).

7. The method of claim 4, wherein said computer calculates an optimal tilt angle based on an algorithm utilizing an equation of closest fit, said equation based on historical data from previous furnace runs, and having at least one independent variable and at least one dependent variable, said at least one independent variable corresponding to said amount of metal poured, said dependent variable corresponding to said optimal tilt angle.

8. The method of claim 7, wherein said equation contains a further independent variable, said further independent variable corresponding to the slag height in said furnace.

9. The method of claim 1, further comprising:

f) introducing into said furnace a vortex inhibitor at a time determined from said amount of metal residuum.

10. The method of claim 2, wherein said computer further determines the time at which a vortex inhibitor is introduced into said furnace.

11. The method of claim 4, wherein a vortex inhibitor is introduced into said furnace, the introduction of said vortex inhibitor controlled by the output of said computer.

12. The method of claim 9 wherein an operator is alerted to said time determined for introduction of said vortex inhibitor, and introduction of said vortex inhibitor is initiated by said operator.

13. An apparatus for the pouring of clean metal from a furnace containing metal and slag, comprising:

a) a side-tapped, tilting furnace;

b) tilt adjusting means for adjusting the tilt angle of said side-tapped tilting furnace;

c) tilt measuring means producing an output which is mathematically related to said tilt angle;

d) charge measuring means providing an output mathematically related to the charge of raw materials to said furnace;

e) a receiving vessel adapted to receive liquid metal from said side tap of said side-tapped tilting furnace;

f) metal pour measuring means providing an output mathematically related to the amount of metal received by said receiving vessel;

g) operator independent means for determining an optimal tilt angle for said side-tapped tilting furnace;

said optimal tilt angle providing for minimal slag entrainment in liquid metal pouring from said side tap, said optimal tilt angle calculated as a function of furnace geometry, and historical data of furnace lining wear for the metal residuum remaining in said furnace, said metal residuum calculated from the amount of metal initially contained in said furnace and the output of said metal pour measuring means.

14. The apparatus of claim 13, wherein said tilt measuring means, said charge measuring means, and said metal pour measuring means outputs comprise data components inputted to a computer, said computer calculating from said data an optimal tilt angle for said side-tapped tilting furnace.

15. The apparatus of claim 14, wherein said computer provides an output causing said tilt adjusting means to tilt said furnace to said optimal tilt angle.

16. The apparatus of claim 13, wherein said tilt measuring means, said charge measuring means, and said metal pour measuring means each provide a visible output such that an operator may cause said tilt adjusting means to tilt said side-tapped tilting furnace to an optimal tilt angle determined by the outputs of said charge measuring means and said metal pour measuring means.

17. The apparatus of claim 13, further comprising slag height measuring means for measuring the height of slag in said side-tapped tilting furnace.

18. The apparatus of claim 13, wherein said slag height measuring means provides an output mathematically related to said slag height, said output comprises a further data component input to said computer, said computer utilizing said further data to calculate said optimal tilt angle.

* * * * *